US011396991B2

(12) United States Patent
Spalding et al.

(10) Patent No.: US 11,396,991 B2
(45) Date of Patent: Jul. 26, 2022

(54) CLEAR OBELISK PROJECTOR SHIELD

(71) Applicant: Flex-N-Gate Advanced Product Development, LLC, Tecumeseh (CA)

(72) Inventors: James Spalding, Dearborn Heights, MI (US); Brett Reid Spencer, Farmington Hills, MI (US)

(73) Assignee: Flex-N-Gate Advanced Product Development, LLC

( * ) Notice: Subject to any disclaimer, the term of this patent is extended or adjusted under 35 U.S.C. 154(b) by 0 days.

(21) Appl. No.: 17/508,752

(22) Filed: Oct. 22, 2021

(65) Prior Publication Data

US 2022/0128208 A1 Apr. 28, 2022

Related U.S. Application Data

(60) Provisional application No. 63/106,207, filed on Oct. 27, 2020.

(51) Int. Cl.

| | |
|---|---|
| ***F21S 41/43*** | (2018.01) |
| ***F21S 41/20*** | (2018.01) |
| ***F21S 41/32*** | (2018.01) |
| ***F21S 41/25*** | (2018.01) |

(52) U.S. Cl.

CPC ..... *F21S 41/43* (2018.01); *F21S 41/25* (2018.01); *F21S 41/28* (2018.01); *F21S 41/321* (2018.01)

(58) Field of Classification Search

None

See application file for complete search history.

(56) References Cited

U.S. PATENT DOCUMENTS

| | | | |
|---|---|---|---|
| 2014/0340924 | A1 | 11/2014 | Matsumoto |
| 2015/0338047 | A1 | 11/2015 | Honda |
| 2018/0372303 | A1 | 12/2018 | Na et al. |

FOREIGN PATENT DOCUMENTS

| | | | |
|---|---|---|---|
| JP | 2015106465 | A | 6/2015 |

OTHER PUBLICATIONS

WIPO Application No. PCT/US2021/056322, International Search Report and Written Opinion of the International Searching Authority, dated Jan. 20, 2022.

*Primary Examiner* — Elmito Breval

(74) *Attorney, Agent, or Firm* — Erise IP, P.A.

(57) ABSTRACT

A projector shield including a clear obelisk optic configured to modulate light exiting a vehicular headlamp. The clear obelisk optic comprises a base configured to sufficiently allow the passage of light therethrough, and a tip configured to refract light thereby preventing it from exiting the vehicular headlamp. The clear obelisk optic generates a light projection having a sufficiently dimmed area compared to surrounding areas.

20 Claims, 8 Drawing Sheets

CLEAR OBELISK PROJECTOR SHIELD

CROSS-REFERENCE TO RELATED APPLICATIONS

This application claims the benefit of U.S. Provisional Patent Application No. 63/106,207 entitled "Clear Obelisk Projector Shield" and filed on Oct. 27, 2020, which is herein incorporated by reference in its entirety.

BACKGROUND OF THE INVENTION

1. Field

The disclosed embodiments relate generally to the field of lighting devices. More specifically, the disclosed embodiments relate to light modulation systems for a vehicle headlamp.

2. Description of the Related Art

Systems to control light exiting a vehicular lamp are known in the art. U.S. Pat. No. 10,655,819 to Na et al. discloses a vehicular lamp comprising a shield for blocking at least a portion of the light. U.S. Pat. No. 11,035,537 to Puech et al. discloses a luminous lighting module for an automotive vehicle which may form a cut-off beam.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

In an embodiment, a light modulation system configured to modulate light exiting a vehicular headlamp is provided. The system includes a light source, a reflector, a projector shield, and an outer lens. The reflector may be configured to reflect light from the light source in a specific direction. The projector shield includes a black metalized portion, which may be configured to form a cutoff light in the light projection. The projector shield includes a transparent optic protruding from the projector shield into the light projection. The transparent optic may redirect a portion of the light projection. The outer lens may be configured to invert the light after passing the projector shield.

In an embodiment, a projector shield for a vehicular headlamp is provided. The projector shield may include a black metalized portion and a clear metalized portion. The black metalized portion may be configured to block a portion of projected light. The clear metalized portion may be coupled to the black metalized portion. The projector shield may also include a clear obelisk optic, which may be coupled to the clear metalized portion. The clear obelisk optic may include a base protruding from the clear metalized portion. The clear obelisk optic may also include a tip protruding from the base. The based may be configured to allow a first portion of light to pass therethrough for projecting from the headlamp. The tip may be configured to refract a second portion of light for preventing the second portion of light from exiting the vehicular headlamp.

In an embodiment, a clear obelisk optic is provided. The clear obelisk optic may be a transparent optic extending from a projector shield of a headlamp. The transparent optic may include a tip portion and a base portion. The tip portion may have four sides angled inwardly. The base portion may be configured to support the tip portion. The tip portion and the base portion together may form an obelisk shape. The tip portion may be configured to redirect a first portion of light for preventing the first portion of light from exiting the headlamp. The base portion may be configured to allow a second portion of light to pass therethrough for projecting from the headlamp.

BRIEF DESCRIPTION OF THE SEVERAL VIEWS OF THE DRAWINGS

Illustrative embodiments are described in detail below with reference to the attached drawing figures, which are incorporated by reference herein and wherein.

Figure 1:
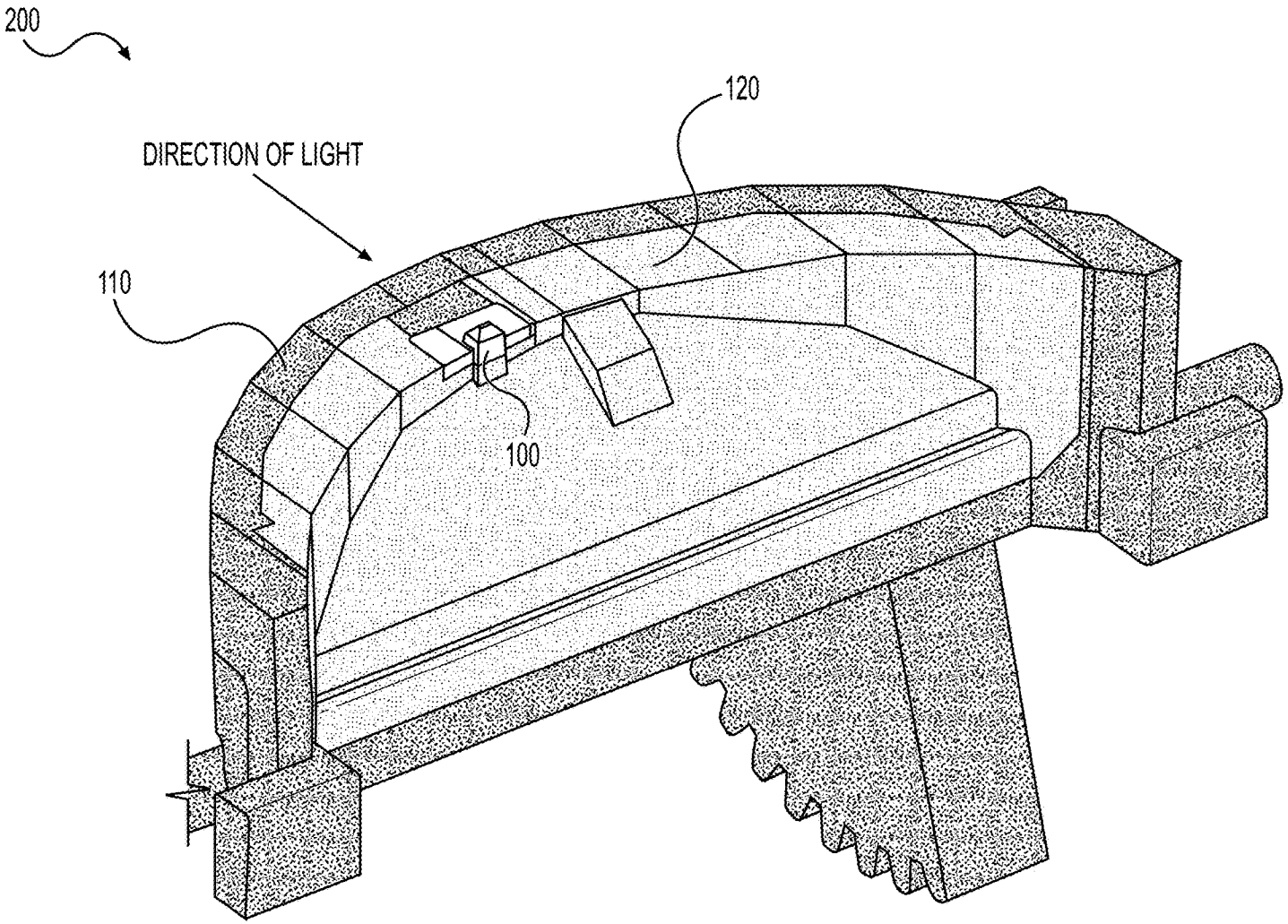
FIG. 1 is a perspective view of a light modulation system of a vehicle headlamp including a projector shield having a clear obelisk optic, in an embodiment.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Vehicle headlamps project a light pattern to meet lighting performance objectives, including a range and an intensity of the light pattern. To avoid glare to an oncoming driver, light modulation systems including a fully opaque shield or a reflective shield (e.g., projector shield) are provided in the headlamp assembly to block a portion of light projected from the projector. The projector shield is configured to block light below a predetermined cutoff angle. The cutoff provides a light pattern in front of the vehicle that is projected downwardly towards the road. For example, the projector shield may be configured to provide a crisp cutoff at a zero degree up/down angle that extends directly in front of the vehicle (e.g., towards the horizon), such that the light pattern is restricted to downward angles below the cutoff. In addition, a specific point in the light pattern below the cutoff has a maximum intensity requirement to avoid glare to an oncoming driver. The specific point is mandated by the U.S. Department of Transportation, National Highway Traffic Safety Administration, and is known as the "legal test point". The legal test point is located at 0.86 degrees down from the cutoff and 3.5 degrees left of center (0.86 D, 3.5 L). To achieve dimming of light below the maximum intensity requirement at the legal test point, traditional projector shields include a fully opaque protrusion corresponding to 0.86 D, 3.5 L. However, this design blocks a larger portion of light than what is necessary at the legal test point, making it difficult to provide sufficient intensity of light in areas around the legal test point. For example, the traditional shield protrusion blocks light between the legal test point and the cutoff, which creates a larger hole in the projected pattern of light than what is required.

Embodiments of the present disclosure provide a light modulation system that more accurately dims light at the legal test point without blocking light in neighboring regions of the light pattern. Rather than using an opaque projector shield protrusion, a transparent optic is used. The transparent optic is shaped like an obelisk and configured to selectively redirect light to provide a fuller light pattern without sacrificing greater reach of the pattern and while maintaining the legal test point requirement.

FIG. 1 is a perspective view of a light modulation system of a vehicle headlamp, including a projector shield 200 having a clear obelisk optic 100. Projector shield 200 includes a black metalized portion 110 configured to block a portion of projected light and to provide a crisp cutoff of the light pattern. Black metalized portion 110 is for example a black metallized material in which a black plastic part (e.g., black polycarbonate) is formed by an injection molding process, followed by the part being coated with a metallic coating. Projector shield 200 also includes a clear metalized portion 120 in which a clear plastic part (e.g., clear polycarbonate) is formed by an injection molding process, followed by the part being coated with a metallic coating. Black metalized portion 110 and clear metalized portion 120 may be a single part formed with a two shot injection molding process (e.g., one shot with black plastic and one shot with clear plastic). In this manner, the first portion is still warm when the second shot is applied such that the two portions are bonded together.

In certain embodiments, clear obelisk optic 100 is formed as part of the clear plastic part during the injection molding process, then protected during the metallic coating step such that it remains uncoated and fully transparent. In this way, projector shield 200 is formed as a single monolithic piece. Alternatively, clear obelisk optic 100 may be a separate part made of any optically clear material such as glass or an optically clear plastic. In these embodiments, both the black metalized portion 110 and the clear metalized portion 120 are made of black plastic (e.g., in one shot) since the clear portion is no longer necessary to produce the clear obelisk optic 100. The separate clear obelisk optic 100 may be attached to projector shield 200 using screw stakes, heat stakes, or an adhesive, for example.

Clear obelisk optic 100 protrudes from projector shield 200, such that an upper portion of clear obelisk optic 100 extends above black metalized portion 110. In some embodiments, clear obelisk optic 100 is a transparent optic protruding from the projector shield into the light projection. In this manner, a portion of light passing above black metalized portion 110 is redirected by at least a portion of clear obelisk optic 100, as further described below in connection with FIGS. 2 and 3. An outer lens (e.g., outer lens 660 of FIGS. 6 and 7) receives the light that passes by projector shield 200, condenses the light, and flips the projected image over (e.g., upside down), such that the portion of the light pattern that is dimmed via the upwardly protruding clear obelisk optic 100 appears below the cutoff in the beam pattern (see FIGS. 4 and 5).

Figure 2:
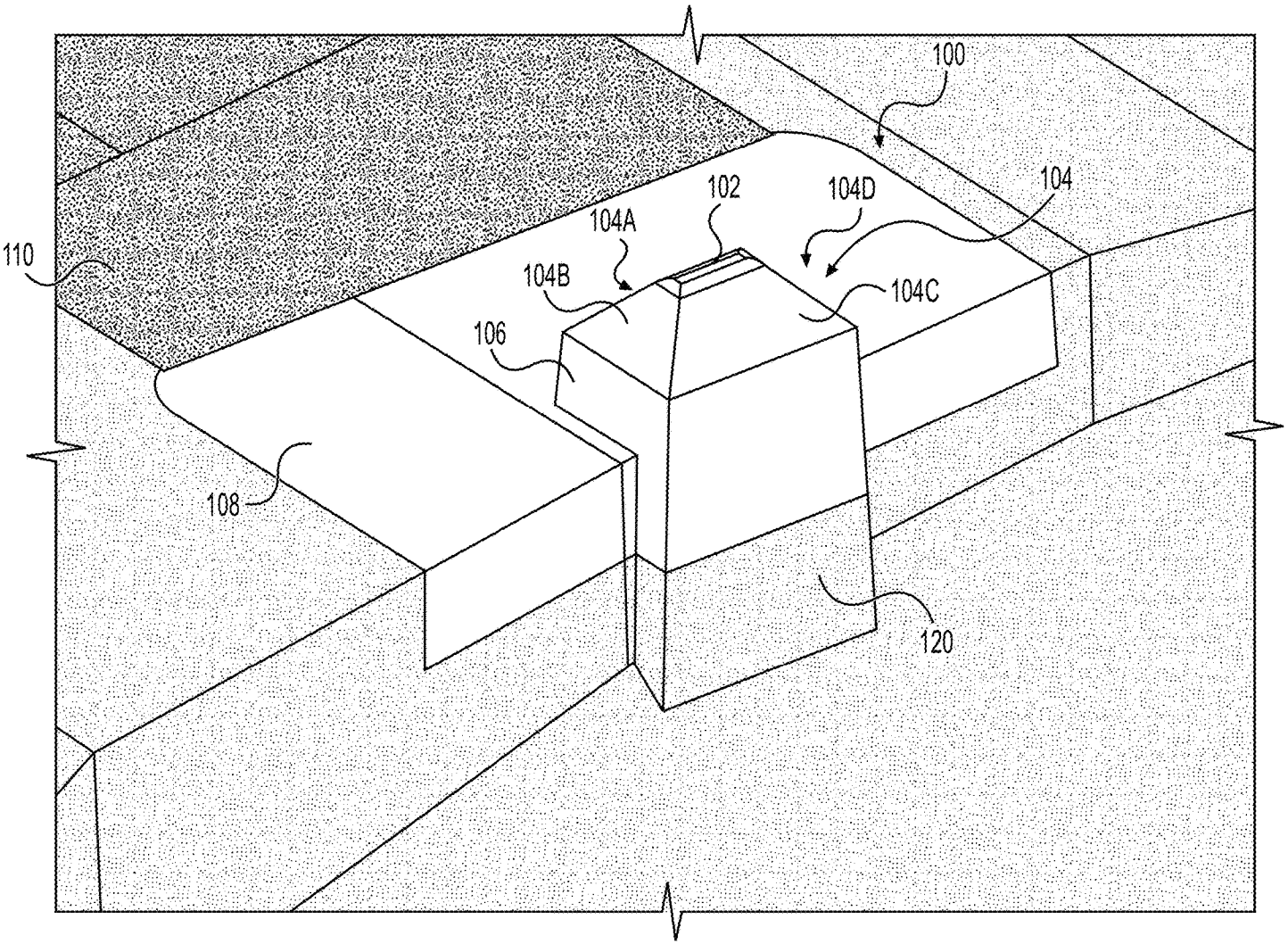
FIG. 2 is a close-up perspective view of the clear obelisk optic of FIG. 1.

FIG. 2 is a close-up perspective view of clear obelisk optic 100. Clear obelisk optic 100 includes a tip 104 and a base 106. Tip 104 is a top portion of optic 100 in which the four sides angle inwardly towards one another to form a pointed end 102. The four angled sides of tip 104 are designated as an entry side 104A, a near side 104B, an exit side 104C, and a far side 104D (see FIG. 2 and FIG. 3). Entry side 104A and exit side 104C are oppositely faced along a longitudinal direction that is in line with the light path. Specifically, entry side 104A faces towards incoming light, whereas exit side 104C faces away from incoming light. Near side 104B and far side 104D are oppositely faced along a transverse direction that is perpendicular to the longitudinal direction and therefore not in line with the light path. An inward angle tilts entry side 104A and exit side 104C towards pointed end 102 at an angle between about thirty-five degrees and about fifty-five degrees. In some embodiments, the inward angle for entry side 104A and exit side 104C is about forty-five degrees. An inward angle tilts the transversely oriented sides 104B, 104D towards pointed end 102 at an angle between about three degrees and about forty-five degrees.

Base 106 is a bottom portion of clear obelisk optic 100 configured to support tip 104. The four sides of base 106 may be vertical, or nearly vertical and having a slight inward angle towards one another. Base 106 is configured to partially protrude upwardly above a clear surface 108. Clear surface 108 is configured to be substantially parallel with a top surface of projector shield 200 (see FIG. 1). Although the different sections of clear obelisk optic 100 are described separately herein, it should be appreciated that clear obelisk optic 100 is, in embodiments, a single piece of material (e.g., formed with a single injection molding shot).

Figure 3:
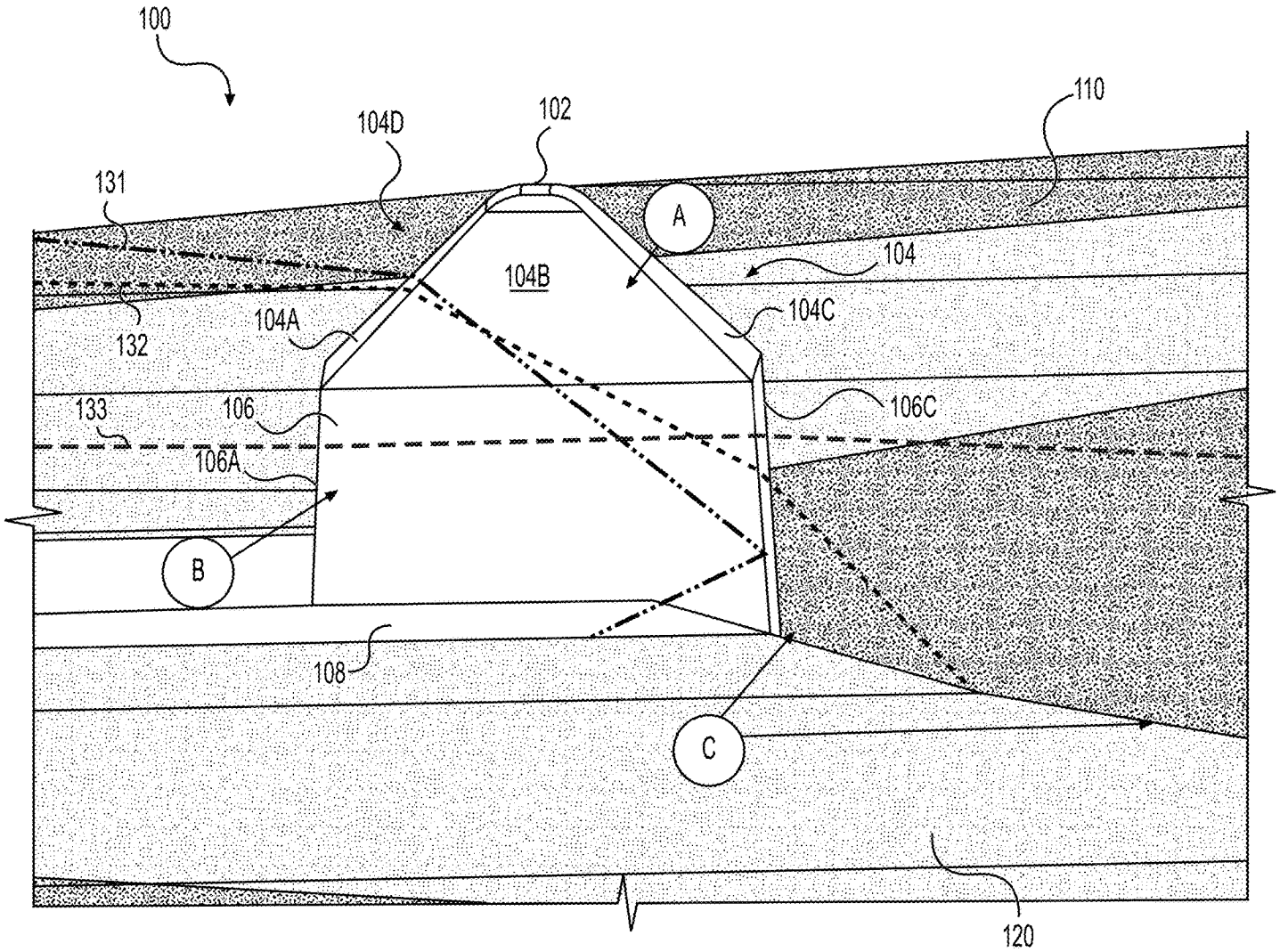
FIG. 3 is an up-close side view of the clear obelisk optic of FIG. 1 showing exemplary light paths.

FIG. 3 is an up-close side view of clear obelisk optic 100 showing a first light path 131, a second light path 132, and a third light path 133. As illustrated in FIG. 3, the light paths 131, 132, 133 are traveling from left to right as they encounter clear obelisk optic 100. A first light path 131 enters clear obelisk optic 100 at tip 104 through entry side 104A and is refracted downwards into base 106 at an angle such that the light reflects internally off of a distal side 106C of base 106. First light path 131, therefore, remains trapped in clear obelisk optic 100 due to total-internal reflection (TIR). In this manner, first light path 131 is effectively blocked from traveling beyond clear obelisk optic 100 such that first light path 131 fails to reach an outer lens and fails to be projected from a headlamp in front of a vehicle. In other words, first light path 131 is refracted by tip 104, such that the refracted light is prevented from exiting the vehicular headlamp.

A second light path 132 enters clear obelisk optic 100 at tip 104 through entry side 104A and is refracted downwards into base 106 at such an angle that the light passes through the distal side 106C of base 106. For example, the downward angle of second light path 132 through clear obelisk optic 100 is less than that of first light path 131 due to the angles at which the light paths reach the entry side 104A. Upon exiting clear obelisk optic 100, second light path 132 is directed downwardly such that it misses an outer lens 660 and is instead absorbed by a lens holder 662 (see FIGS. 6 and 7). Therefore, second light path 132 is also effectively blocked as it fails to reach the outer lens and is not projected from the vehicle headlamp. In other words, second light path 132 is refracted by tip 104, such that the refracted light is prevented from exiting the vehicular headlamp.

A third light path 133 enters clear obelisk optic 100 at base 106 and is only marginally refracted such that third light path 133 enters the base 106 on a proximal side 106A and exits on the distal side 106C at an angle that deviates only slightly from the entry angle. Therefore, third light path 133 reaches the outer lens and is projected from the vehicle headlamp. In this manner, light that enters tip 104 is effectively prevented from exiting the vehicle headlamp, while light that enters base 106 effectively permits light to be projected from the vehicle headlamp. Thus, clear obelisk optic 100 may be used to substantially dim light at the legal test point via tip 104, and to substantially illuminate regions outside of the legal test point, in particular the region between the cutoff and the legal test point. In other words, the result of using clear obelisk optic 100 in projector shield 200 is a small spot of reduced light intensity in the projected light pattern, as illustrated in FIG. 4.

It is contemplated that clear obelisk optic 100 may be a transparent optic. Transparent optic may similarly include a base portion and a tip portion that do not form a substantially obelisk shape, but any other shape which may similarly refract light bidirectionally. For example, transparent optic may be elliptically shaped, including a base portion configured to allow the passage of light therethrough and a tip portion configured to refract light, such that the refracted light does not exit the vehicular headlamp. In another example, transparent optic may be pyramidally shaped, including a base portion configured to allow the passage of light therethrough and a tip portion configured to refract light, such that the refracted light does not exit the vehicular headlamp. It is contemplated that the transparent optic may comprise any shape which includes a base portion and a tip portion, said base portion and tip portion configured to alternatively refract light to modulate the light projection from a vehicular headlamp.

Figure 4:
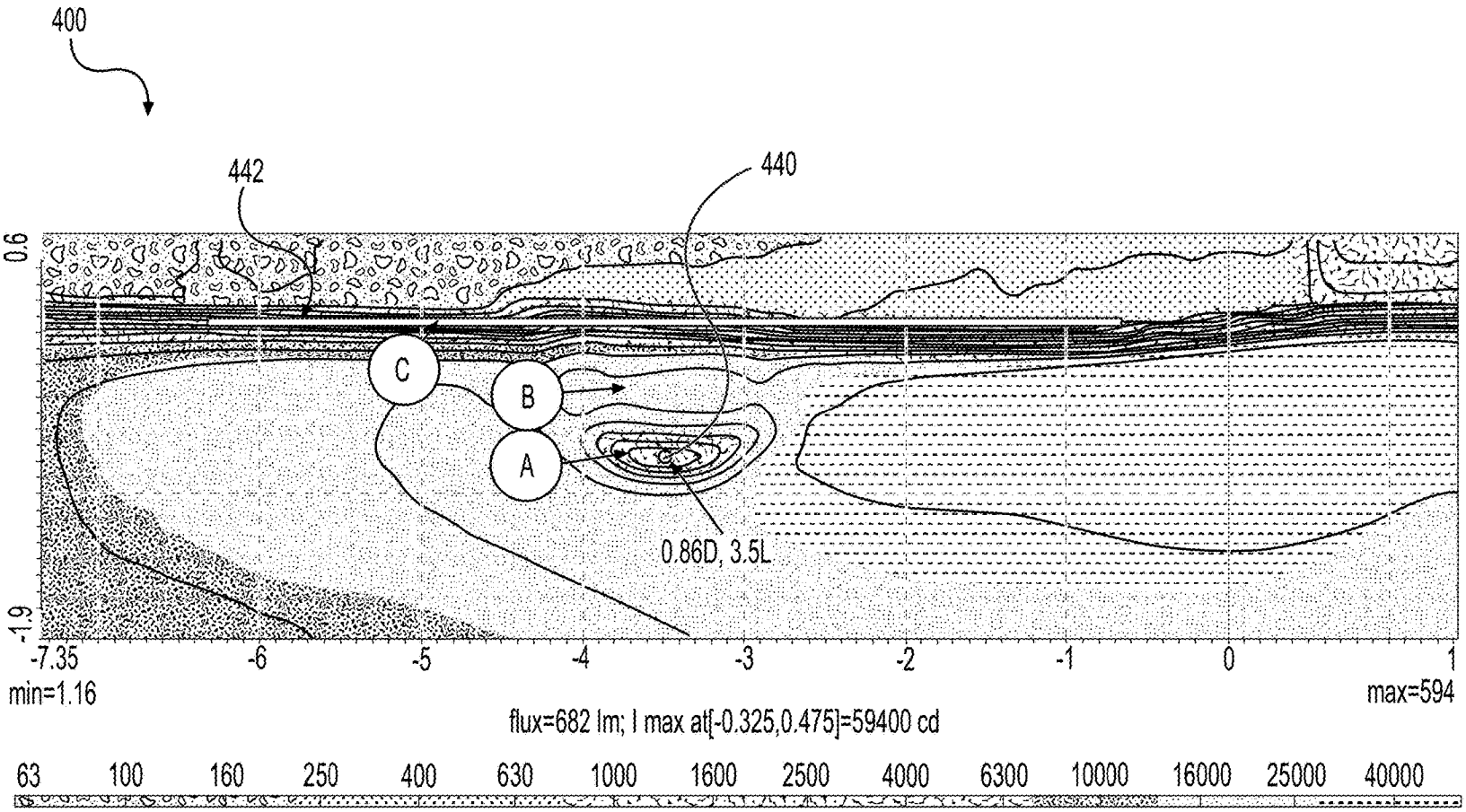
FIG. 4 shows a contour plot of light intensity imaged from a vehicle headlamp of FIG. 6 having the clear obelisk optic of FIG. 1.
Figure 6:
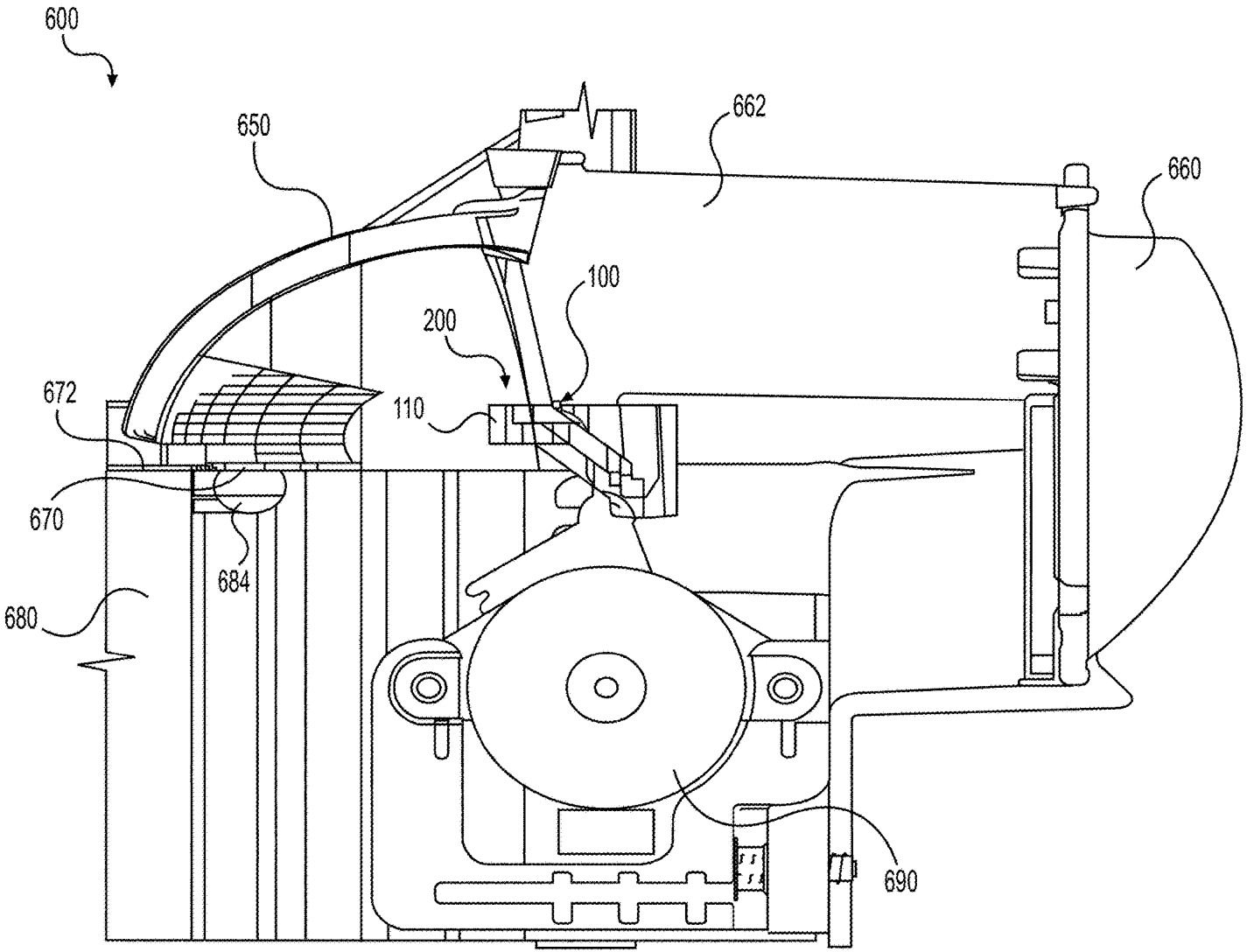
FIG. 6 is a cross-sectional side view of a vehicle headlamp having the clear obelisk optic of FIG. 1, in an embodiment.

FIG. 4 shows a contour plot 400 of light intensity imaged from vehicle headlamp 600 of FIG. 6 having clear obelisk optic 100. The rainbow color scale on FIG. 4 shows a range of light intensity from a low intensity of about 63 cd represented with dark blue, to a high light intensity of about 40,000 cd, represented in red. A legal test point 440 is plotted at −0.86 degrees down and 3.5 degrees left of center (0.86 D, 3.5 L). The region immediately around legal test point 440, which is labeled region "A" in FIG. 4, has a substantially reduced light intensity (e.g., approximately 2,500 cd) compared to that of surrounding regions of the light pattern. For example, the area above Region A, which is labeled region "B" in FIG. 4, has a comparatively higher light intensity (e.g., approximately 25,000 cd). A cutoff line 442 shows where light intensity is cut off via black metalized portion 110 such that the region immediately above cutoff line 442, which is labeled region "C" in FIG. 4, has very low levels of light intensity (e.g., approximately 250 cd).

The A, B, and C regions illustrated in FIG. 4 correspond with portions of clear obelisk optic 100 and black metalized portion 110 from FIG. 3. For example, region A corresponds with light traveling into an upper portion of tip 104 (labeled "A" in FIG. 3) that remains trapped in clear obelisk optic 100 due to TIR, such as first light path 131 of FIG. 3. Region B in FIG. 4 corresponds with light passing through base 106 (labeled "B" in FIG. 3), such as third light path 133 of FIG. 3. Region C in FIG. 4 corresponds with light that passes through tip 104, refracts downwardly, and exits clear obelisk optic 100 on a downward trajectory angled below black metalized portion 110 (labeled "C" in FIG. 3), such as second light path 132 of FIG. 3.

Illuminating region B with a relatively high light intensity (e.g., approximately 25,000 cd) compared to a relatively dim light intensity in region A (e.g., approximately 2,500 cd) is not possible using a traditional opaque shield protrusion, which substantially dims light in region B similar to that of region A. Minor light leak/bleed allows enough light to reach region A for meeting minimum requirements set by Federal Motor Vehicle Safety Standards (FMVSS).

Figure 5A:
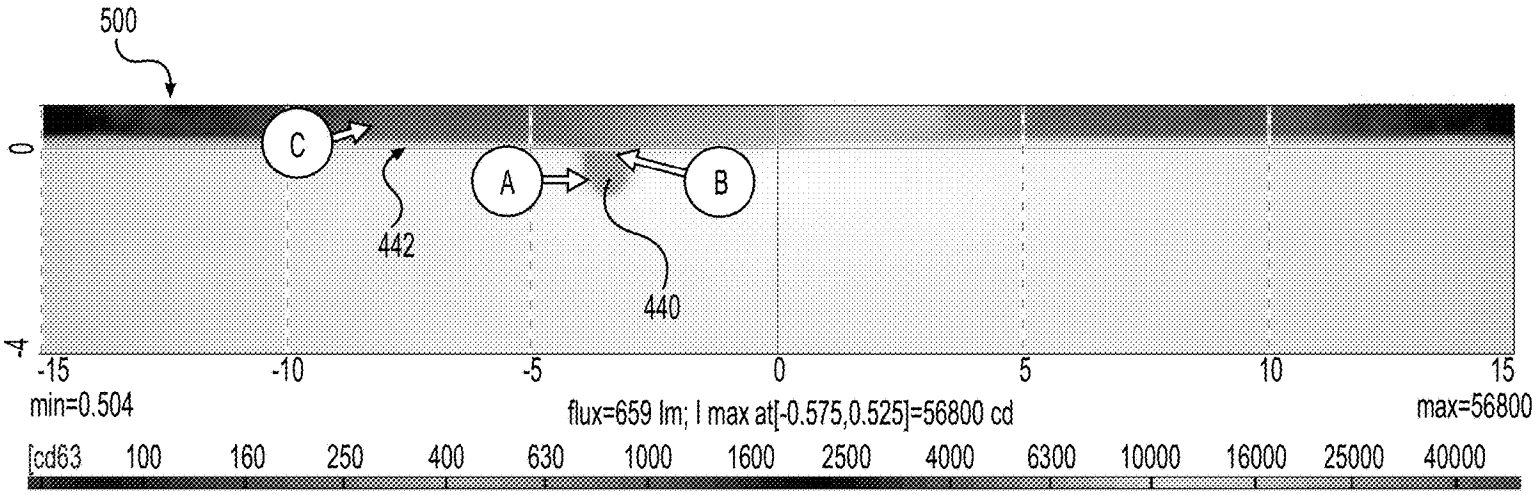
FIG. 5A shows a greyscale image of a light pattern resulting from a traditional vehicle headlamp.
Figure 5B:
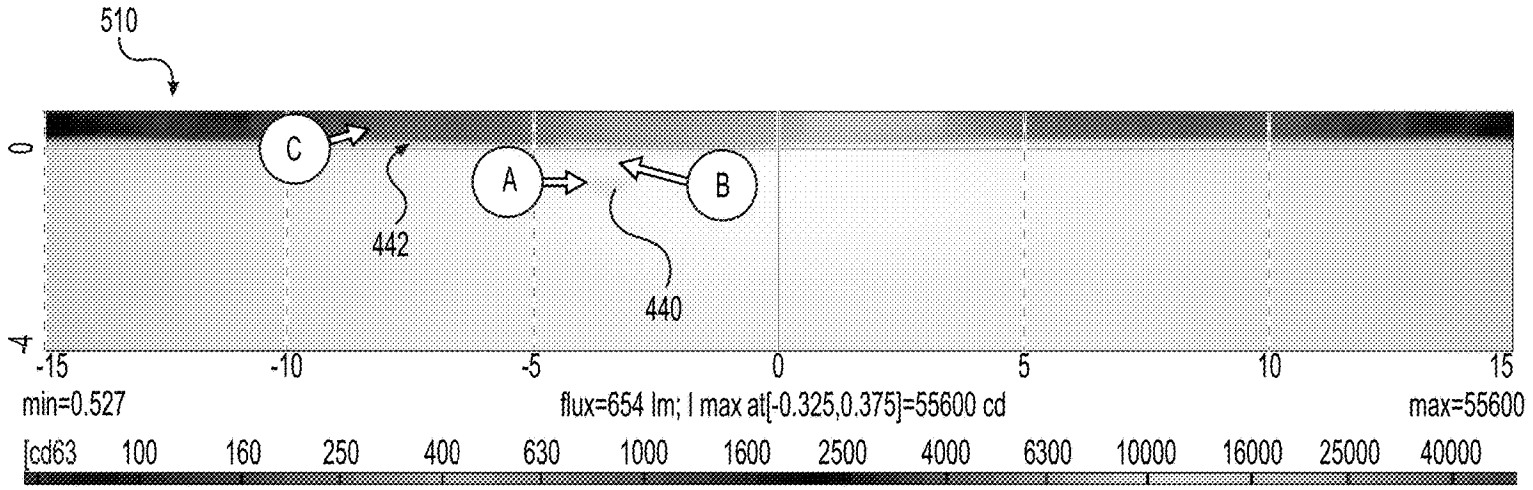
FIG. 5B shows a greyscale image of a light pattern resulting from a vehicle headlamp of FIG. 6 having the clear obelisk optic of FIG. 1.

FIGS. 5A and 5B show exemplary light patterns from a vehicle headlamp. In FIG. 5A, a greyscale image 500 shows a light pattern resulting from a traditional vehicle headlamp, having a traditional opaque protrusion extending from the cutoff shield, to block light at legal test point 440 (region A) and at the area between legal test point 440 and cutoff line 442 (region B). In FIG. 5B, a greyscale image 510 shows a light pattern resulting from vehicle headlamp 600 of FIG. 6 having clear obelisk optic 100, which protrudes from the cutoff shield to dim light around legal test point 440 (region A) but not in the area between legal test point 440 and cutoff line 442 (region B). Region A in FIG. 5B is dimmed (to about 2,500 cd), whereas region A in FIG. 5A is effectively blocked (to about 500 cd). Region B in FIG. 5B is substantially illuminated like other portions of the illuminated light pattern (to about 25,000 cd), whereas in FIG. 5A, region B is effectively blocked (to about 500 cd).

Figure 7:
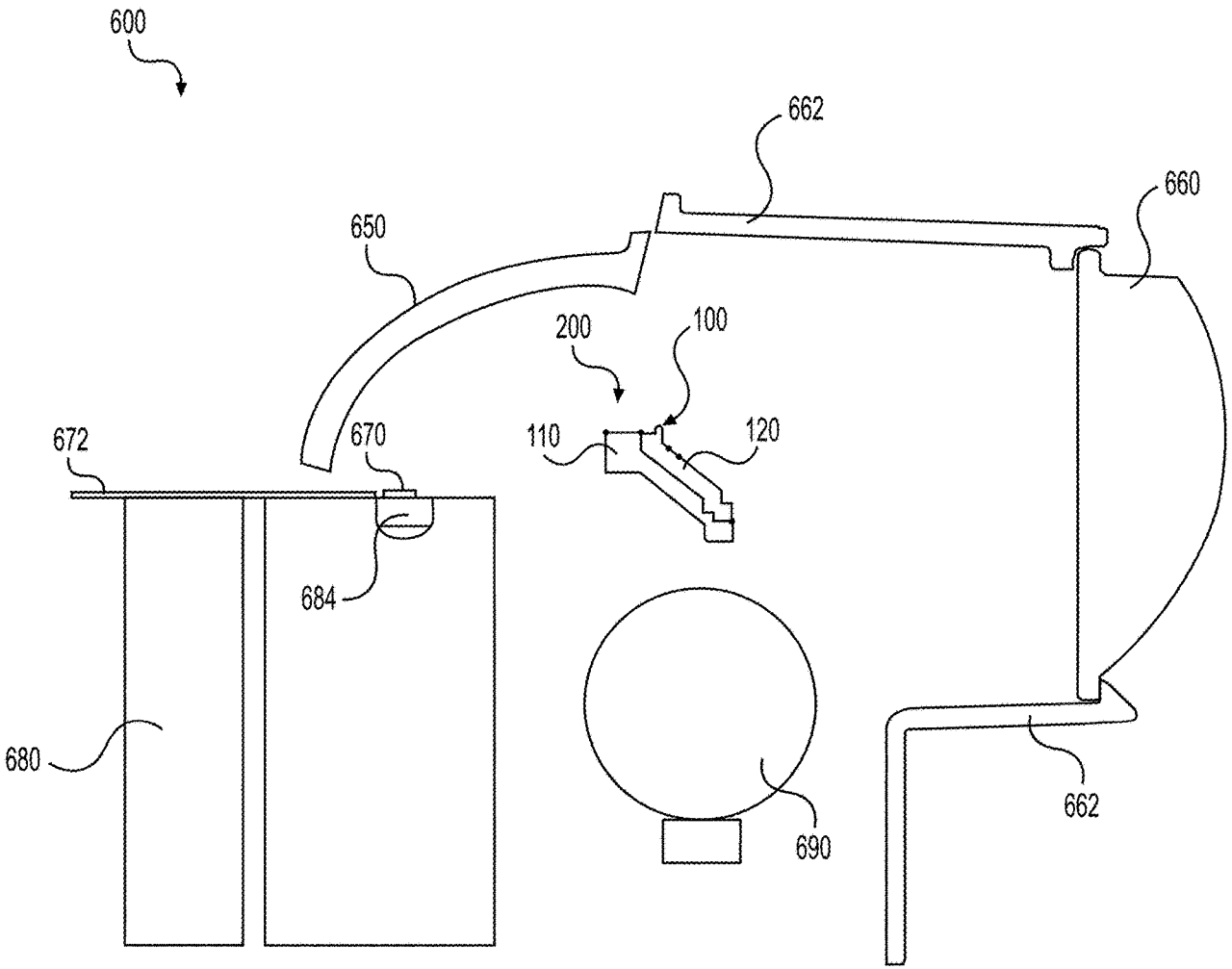
FIG. 7 illustrates a cross-section through the vehicle headlamp of FIG. 6.

FIG. 6 is a cross-sectional side view of a vehicle headlamp 600. FIG. 7 illustrates a cross-section through vehicle headlamp 600 corresponding with the view shown in FIG. 6. FIGS. 6 and 7 are best viewed together with the following description.

A light source 670 provides light for projecting from vehicle headlamp 600. Light source 670 is, for example, a light-emitting diode (LED) or an array of LEDs electrically coupled with a printed circuit board 672. A heat pipe 684 is thermally coupled with light source 670 for removing heat produced by light source 670. A heat sink 680 is thermally coupled with heat pipe 684 for dispersing heat to the surrounding environment. For example, heat sink 680 may include a series of fins for transferring heat to ambient air via convection.

Light from light source 670 is directed upwards towards a reflector 650, which reflects the light towards outer lens 660. Lens holder 662 holds lens 660 in place and is black to absorb any stray light. Black metalized portion 110 blocks a lower portion of light reflected off of reflector 650. Clear obelisk optic 100 protrudes above black metalized portion 110 to redirect a portion of light as explained above in connection with FIGS. 3 and 4. Outer lens 660 condenses the light and flips the image upside down such that the blocked light is above the illuminated portion in the projected light pattern (as shown in FIG. 5B).

An optional motor 690 enables rotation of projector shield 200 for moving it out of the light path to provide a high beam light pattern with no cutoff. It should be noted that clear obelisk optic 100 may be used in a bi-functional headlamp (e.g., providing a low beam and a high beam), such as vehicle headlamp 600, or simply with any low beam headlamp.

Figure 8A:
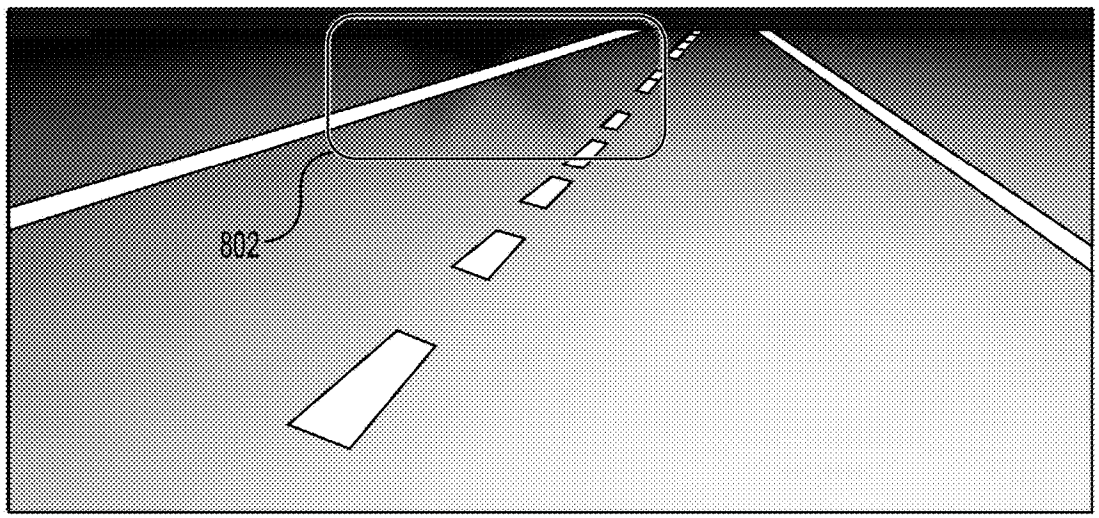
FIG. 8A shows an illuminated road scene from a pair of traditional headlamps.
Figure 8B:
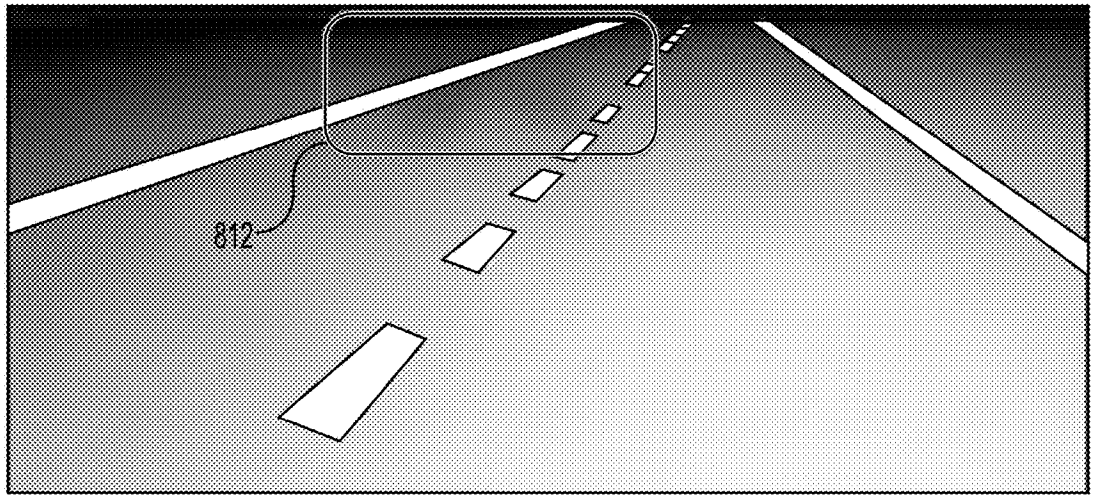
FIG. 8B shows an illuminated road scene from a pair of vehicle headlamps that each include the clear obelisk optic of FIG. 1.

FIGS. 8A and 8B show exemplary road scenes illuminated with a pair of vehicle headlamps. In FIG. 8A, a road scene 800 shows an illuminated road scene from a pair of traditional headlamps. Since each of the traditional headlamps has an opaque protrusion extending from the cutoff shield to block light at legal test point 440 (region A in FIG. 5A), light is also blocked at the area between legal test point 440 and cutoff line 442 (region B in FIG. 5A). As shown in the highlighted area 802 of FIG. 8A, this results in the pair of dimmed portions (from the pair of vehicle headlamps) being noticeably darker due to a "hole" in the light pattern where the light is effectively blocked and no illumination on the road is present.

In contrast, FIG. 8B shows a road scene 810 illuminated with a pair of vehicle headlamps (e.g., headlamp 600) that each include clear obelisk optic 100 protruding from the cutoff shield, which produces a light pattern like that shown in FIG. 5B where light is dimmed around legal test point 440 (region A in FIG. 5B) but not in the area between legal test point 440 and cutoff line 442 (region B in FIG. 5B). As shown in the highlighted area 812 of FIG. 8B, this results in the pair of dimmed portions (from the pair of vehicle headlamps) being less noticeable compared to FIG. 8A since there is no hole in the light pattern.

Features described above as well as those claimed below may be combined in various ways without departing from the scope hereof. The following examples illustrate some possible, non-limiting combinations:

(A1) A light modulation system is configured to modulate a light projection exiting a vehicular headlamp, the system includes a light source, a reflector configured to reflect light from the light source in a specific direction, a projector shield which includes a black metalized portion configured to form a cutoff line in the light projection, a transparent optic protruding from the projector shield into the light project, the transparent optic configured to redirect a portion of the light projection, and an outer lens configured to invert the light after passing the projector shield.

(A2) For the light modulation system denoted as (A1), the transparent optic may include a base that may be configured to allow the passage of light therethrough, and a tip that may be configured to refract light preventing a refracted light from exiting the vehicular headlamp.

(A3) For the light modulation system denoted as (A1) or (A2), the tip may include four sides angled inwardly, said sides may be configured to refract light towards the base.

(A4) For the light modulation system denoted as any of (A1) through (A3), the system may include a motor operatively connected to the projector shield, the motor may be configured to adjust a position of the projector shield therein removing the cutoff line from the light projection.

(A5) For the light modulation system denoted as any of (A1) through (A4), the transparent optic may be one of a clear plastic or a glass.

(A6) For the light modulation system denoted as any of (A1) through (A5), the transparent optic may cause a first area within the light projection to be dimmer than other areas in the light projection not affected by the transparent optic.

(A7) For the light modulation system denoted as any of (A1) through (A6), the projector shield may include a clear metalized portion aligned with the black metalized portion.

(A8) For the light modulation system denoted as any of (A1) through (A7), the clear metalized portion and the transparent optic may be formed of one piece of material and the transparent optic may be an extension of the clear metalized portion that may be configured to extend into the light projection.

(A9) For the light modulation system denoted as any of (A1) through (A8), the system may include a lens holder that mechanically couples the outer lens to the light modulation system, the lens holder may be configured to absorb the refracted light.

(A10) For the light modulation system denoted as any of (A1) through (A9), the transparent optic may cause a second area within the light projection to be substantially as bright as the other areas in the light projection, said second area may be located between the first area and the cutoff line.

(B1) A projector shield for a vehicular headlamp includes a black metalized portion configured to block a portion of projected light, a clear metalized portion coupled to the black metalized portion, and a clear obelisk optic coupled to the clear metalized portion, the clear obelisk optic includes a base protruding from the clear metalized portion, and a tip protruding from the base, the base is configured to allow a first portion of light to pass therethrough for projecting from the headlamp, and the tip is configured to refract a second portion of light for preventing the second portion of light from exiting the vehicular headlamp.

(B2) For the projector shield denoted as (B1), the clear obelisk optic may include a clear surface connected to the base opposite the tip, the clear surface may be coupled to the clear metalized portion.

(B3) For the projector shield denoted as (B1) or (B2), the clear obelisk optic may be an extension of the clear metalized portion.

(B4) For the projector shield denoted as any of (B1) through (B3), the base and the tip of the clear obelisk optic may form an obelisk shape.

(B5) For the projector shield denoted as any of (B1) through (B4), the clear obelisk optic may be one of a clear plastic or a glass.

(C1) A clear obelisk optic includes a transparent optic extending from a projector shield of a headlamp, the transparent optic includes a tip portion having four sides angled inwardly and a base portion configured to support the tip portion, the tip portion and the base portion together form an obelisk shape and the tip portion is configured to redirect a first portion of light for preventing the first portion of light from exiting the headlamp and the base portion is configured to allow a second portion of light to pass therethrough for projecting from the headlamp.

(C2) For the clear obelisk optic denoted as (C1), the four sides of the tip portion may be angled inwardly at an angle between thirty-five degrees to fifty-five degrees.

(C3) For the clear obelisk optic denoted as (C1) or (C2), the clear obelisk optic may be made of a clear plastic.

(C4) For the clear obelisk optic denoted as any of (C1) through (C3), the clear obelisk optic may be made of glass.

(C5) For the clear obelisk optic denoted as any of (C1) through (C4), the clear obelisk optic may include a clear surface coupled to a clear metalized portion of the projector shield.

Many different arrangements of the various components depicted, as well as components not shown, are possible without departing from the spirit and scope of what is claimed herein. Embodiments have been described with the intent to be illustrative rather than restrictive. Alternative embodiments will become apparent to those skilled in the art that do not depart from what is disclosed. A skilled artisan may develop alternative means of implementing the aforementioned improvements without departing from what is claimed.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A light modulation system configured to modulate a light projection exiting a vehicular headlamp, the system comprising:
- a light source;
- a reflector configured to reflect light from the light source in a specific direction;
- a projector shield comprising:
  - a black metalized portion configured to form a cutoff line in the light projection;
  - a transparent optic protruding from the projector shield into the light projection,
  - wherein the transparent optic is configured to redirect a portion of the light projection; and
- an outer lens configured to invert the light after passing the projector shield.

2. The light modulation system of claim 1, wherein the transparent optic comprises a base configured to allow the passage of light therethrough, and a tip configured to refract light preventing a refracted light from exiting the vehicular headlamp.

3. The light modulation system of claim 2, wherein the tip comprises four sides angled inwardly, said sides configured to refract light towards the base.

4. The light modulation system of claim 2, further comprising a lens holder that mechanically couples the outer lens to the light modulation system, wherein the lens holder is configured to absorb the refracted light.

5. The light modulation system of claim 1, further comprising a motor operatively connected to the projector shield, wherein the motor is configured to adjust a position of the projector shield therein removing the cutoff line from the light projection.

6. The light modulation system of claim 1, wherein the transparent optic comprises one of a clear plastic or a glass.

7. The light modulation system of claim 1, wherein the transparent optic causes a first area within the light projection to be dimmer than other areas in the light projection not affected by the transparent optic.

8. The light modulation system of claim 7, wherein the transparent optic causes a second area within the light projection to be substantially as bright as the other areas in the light projection, said second area located between the first area and the cutoff line.

9. The light modulation system of claim 1, wherein the projector shield further comprises a clear metalized portion aligned with the black metalized portion.

10. The light modulation system of claim 9, wherein the clear metalized portion and the transparent optic are formed of one piece of material and the transparent optic is an extension of the clear metalized portion configured to extend into the light projection.

11. A projector shield for a vehicular headlamp, said projector shield comprising:
- a black metalized portion configured to block a portion of projected light;
- a clear metalized portion coupled to the black metalized portion; and
- a clear obelisk optic coupled to the clear metalized portion, the clear obelisk optic comprising:
  - a base protruding from the clear metalized portion; and
  - a tip protruding from the base,
    - wherein the base is configured to allow a first portion of light to pass therethrough for projecting from the headlamp, and
    - the tip is configured to refract a second portion of light for preventing the second portion of light from exiting the vehicular headlamp.

12. The projector shield of claim 11, wherein the clear obelisk optic further comprises a clear surface connected to the base opposite the tip, said clear surface coupled to the clear metalized portion.

13. The projector shield of claim 11, wherein the clear obelisk optic is an extension of the clear metalized portion.

14. The projector shield of claim 11, wherein the base and the tip of the clear obelisk optic form an obelisk shape.

15. The projector shield of claim 11, wherein the clear obelisk optic comprises one of a clear plastic or a glass.

16. A clear obelisk optic, comprising:
- a transparent optic extending from a projector shield of a headlamp, the transparent optic comprising:
  - a tip portion having four sides angled inwardly; and
  - a base portion configured to support the tip portion;
    - wherein the tip portion and the base portion together form an obelisk shape; and
    - wherein the tip portion is configured to redirect a first portion of light for preventing the first portion of light from exiting the headlamp, and the base portion is configured to allow a second portion of light to pass therethrough for projecting from the headlamp.

17. The clear obelisk optic of claim 16, wherein the four sides of the tip portion are angled inwardly at an angle between thirty-five degrees to fifty-five degrees.

18. The clear obelisk optic of claim 16, wherein the clear obelisk optic is made of a clear plastic.

19. The clear obelisk optic of claim 16, wherein the clear obelisk optic is made of glass.

20. The clear obelisk optic of claim 16, further comprising a clear surface coupled to a clear metalized portion of the projector shield.

* * * * *